United States Patent [19]

Steele

[11] 4,193,630

[45] Mar. 18, 1980

[54] SELF CONTAINING COLLAPSIBLE HIGH CHAIR

[76] Inventor: Blake H. Steele, 323 Westlake St., Cartago, Calif. 93520

[21] Appl. No.: 939,279

[22] Filed: Sep. 5, 1978

[51] Int. Cl.[2] ..... A47C 4/00

[52] U.S. Cl. ..... 297/17; 16/163

[58] Field of Search ..... 297/17, 182, 112, 153, 297/139; 16/163

[56] References Cited

U.S. PATENT DOCUMENTS

| | | | |
|---|---|---|---|
| 395,196 | 12/1888 | Andrew | 16/163 |
| 854,154 | 5/1907 | Domsgen et al. | 297/17 X |
| 1,419,947 | 6/1922 | Schouten | 297/17 |
| 2,589,372 | 3/1952 | Hake | 297/17 |
| 2,971,570 | 2/1961 | Van der Bush | 297/139 X |
| 3,909,061 | 9/1975 | Johnson | 297/17 |
| 4,025,107 | 5/1977 | Chippa | 297/17 |
| 4,079,992 | 3/1978 | Thrift | 297/17 |

*Primary Examiner*—Ramon S. Britts
*Assistant Examiner*—Peter A. Aschenbrenner
*Attorney, Agent, or Firm*—Brown & Martin

[57] ABSTRACT

A high chair having a seat and back which are both hollow and are hinged together to fold and close against each other to form a carrying case, with a handle which locks the case in closed position. Telescopically adjustable legs are attached to the seat by compound hinges, which allow the legs to spread to a wide stable stance when erected, while enabling the legs to be compactly folded into the seat. A tray is attached to the back on adjustable arms and, when not in use, is stored within the hollow back, the tray being the only part which is completely detached for storage. In the collapsed condition only the tray supporting arms are outside the case and they are folded into recesses along the sides of the back. The chair is easily erected and collapsed without tools.

13 Claims, 16 Drawing Figures

SELF CONTAINING COLLAPSIBLE HIGH CHAIR

BACKGROUND OF THE INVENTION

High chairs for infants are large and clumsy for the purpose they serve and require considerable storage space. Many different structures have been devised to allow parts of a chair to be folded or dismantled when not in use. Too often the mechanisms are complex, and various catches, foldable members and the like are accessible to an infant seated in the chair, which can result in injury or even inadvertent collapsing of parts of the chair.

Some chairs have been designed to collapse completely into a compact package, which can be carried in the form of a piece of luggage. In some types, the legs and side arms are detached and stored in the seat or other major structural element, which is time consuming and requires numerous fasteners to be operated. The usual tray must also be stored and, if this is to be enclosed in the main structure, is necessarily smaller than the seat, which itself has size limitations to accommodate and support an infant.

Other types of structures have foldable components which are stored against the outside of the main structure. This type of assembly is unattractive in appearance and the external components tend to snag on other articles when the folded chair is stored, or when traveling with other luggage.

One particularly undesirable feature common to many foldable chairs is the reduced size of the leg base, due to compromises in folding the legs into the structure. Often the legs extend straight down from the seat, resulting in a small leg base and making the chair easy to tip over. The legs can be attached to inclined brackets to provide a stable spread of the legs, but usually must be detached for storage.

SUMMARY OF THE INVENTION

The high chair described herein has a seat and back which are hollow and are connected by a double hinge to fold and close together in the form of an attractive case, with a convenient carrying handle which secures the two parts in closed position. The only part which is completely detached is the tray, which is stored in the back of the chair. The back and seat have flared interfitting rims which will accommodate a large tray when closed. Tray supporting arms on the sides of the back telescope and rotate to store in recesses in the back.

Legs are mounted under the seat on compound hinges, which allow the legs to spread and provide a stable supporting base for the chair. Telescopic braces with simple release catches permit the legs to be hinged inwardly and then upwardly, the legs themselves telescopic in length to store completely within the seat.

The collapsed chair resembles an attractive piece of luggage and has no protruding external elements which can snag on other objects. All catches and retainers are of quick operating type and are either inaccessible to an infant in the chair, or designed so that their operation will not cause injury or collapse of the structure.

The primary object of this invention, therefore, is to provide a new and improved collapsible high chair.

Another object of this invention is to provide a high chair which can be quickly collapsed into an attractive carrying case.

Another object of this invention is to provide a collapsible high chair which, when erected, is stable and safe for an infant to occupy.

A further object of this invention is to provide a collapsible high chair which is simple in structure and economical to manufacture.

Other objects and advantages will be apparent in the following detailed description, taken in conjunction with the accompanying drawings, in which.

DESCRIPTION OF THE PREFERRED EMBODIMENT

Figure 1:
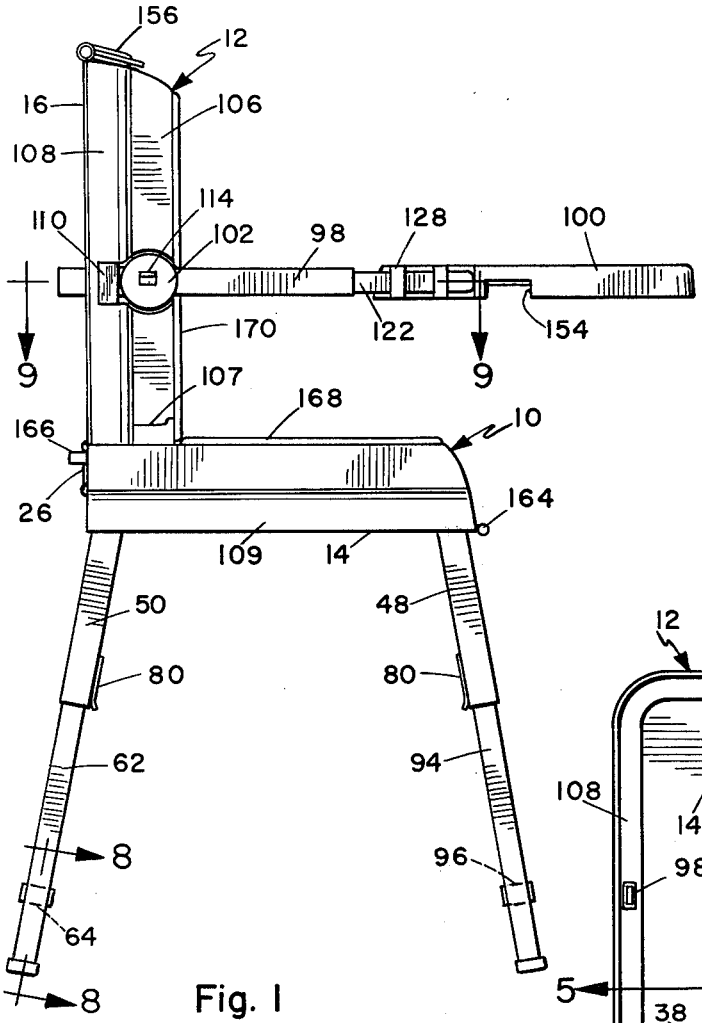
FIG. 1 is a side elevation view of the erected chair.

The chair comprises a seat 10 and a back 12, which are generally similar hollow shells of plastic, fiber reinforced material, or the like. Seat 10 is open on the underside and back 12 is open at the rear, the open sides having interfitting flanged edges 14 and 16, respectively, which join the two elements into a closed case 18, as in FIG. 2. The seat and back are connected by a double hinge including hinge elements 20 along the lower rear edge of back 12, and hinge elements 22 aross the central portion of the rear wall 24 of seat 10. The hinge elements are joined by a link 26 and hinge pins 28 and 30. From the closed position the back swings around through 270 degrees, and stands upright with its lower wall 32 resting on the rear portion of the top panel 34 of the seat.

Figure 5:
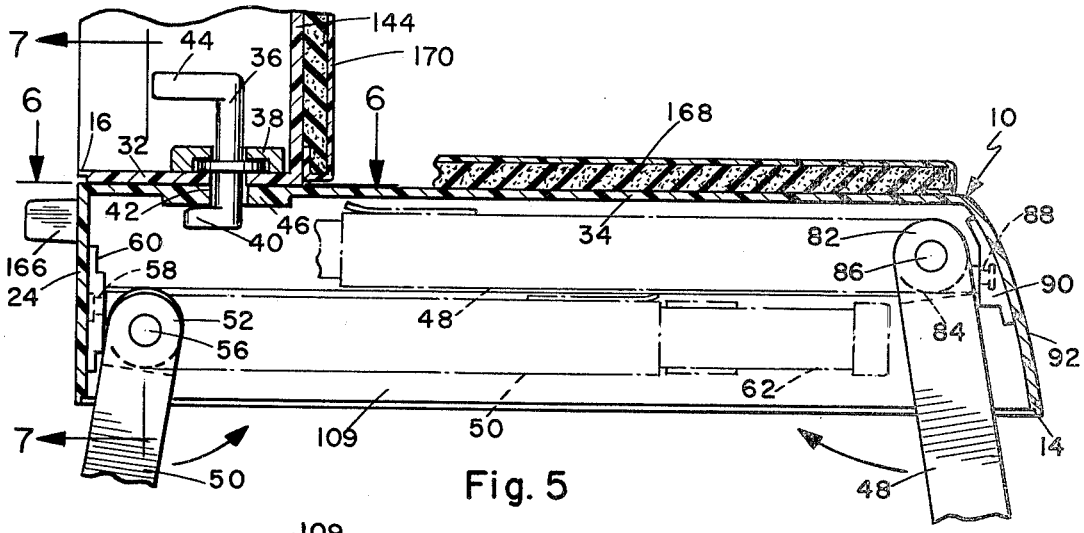
FIG. 5 is an enlarged sectional view taken on line 5—5 of FIG. 3.

Back 12 is secured in the erect position by a pair of clamps 36, each of which is rotatably mounted in a bearing 38 on lower wall 32 and has a locking hook portion 40 which projects downwardly through a keyhole slot 42 in the seat top panel 34. A handle 44 on the top of the clamp 36 allows the hook portion 40 to be rotated to engage a reinforced clamp pad 46 surrounding slot 42, as in FIG. 5.

Figure 6:
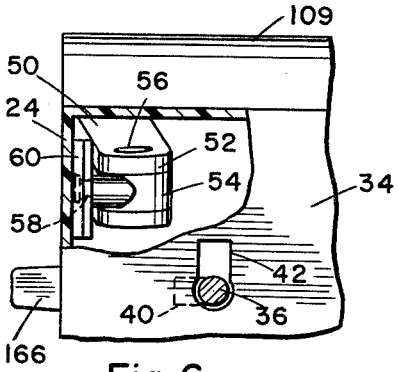
FIG. 6 is a sectional view taken on line 6—6 of FIG. 5.
Figure 7:
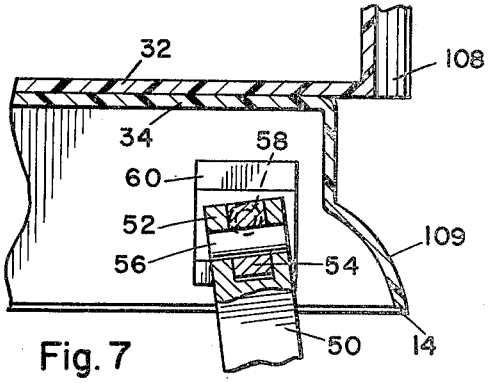
FIG. 7 is a sectional view taken on line 7—7 of FIG. 5.
Figure 8:
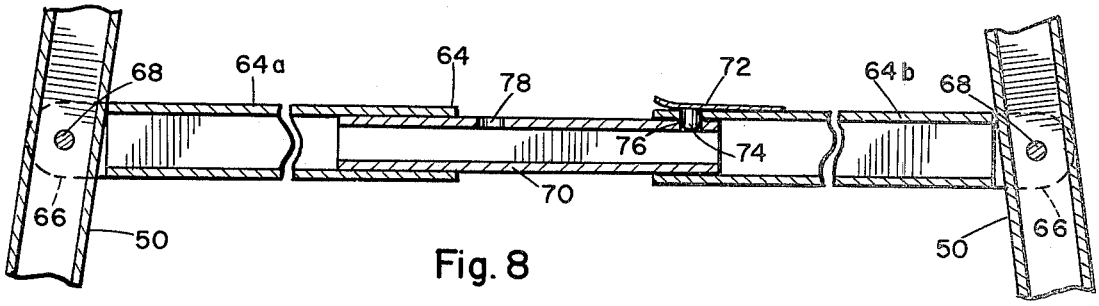
FIG. 8 is an enlarged sectional view taken on line 8—8 of FIG. 1.

The chair is supported on a pair of front legs 48 and a pair of rear legs 50, which are hinged to the seat in a novel manner. Each rear leg 50 has a forked upper end 52 which is hinged to a bearing block 54 by a hinge pin 56, to swing from front to rear. The bearing block 54 has a pin 58 extending from front to rear in the seat, perpendicular to hinge pin 56, which is journalled in a support plate 60 fixed to the inner face of rear wall 24 adjacent the lower outer corner, as in FIGS. 5–7. As illustrated, the rear legs rest against their respective support plates which act as stops to limit rearward inclination, but other stop means could be incorporated.

Legs 50 have telescopic lower portions 62, which are joined near their lower ends by a cross brace 64. The cross brace has two end portions 64*a* and 64*b*, each with a forked end 66 which is pivotally attached to the respective leg 50 by a pin 68. The ends are joined by a central portion 70, which is fixed in end portion 64*a* and is telescopically slidable in end portion 64*b*. A spring catch 72 mounted on end portion 64*b* has a locking pin 74 which projects into a hole 76 in central portion 70, to hold the cross brace in extended position with legs 50 spread well apart. By lifting catch 72 the central portion 70 is released to telescope into end portion 64*b*, where locking pin 74 engages another hole 78 to hold the cross brace closed. In this position the legs 50 are substantially parallel and will fold into the seat 10. Catches 80, similar to catch 72, are used on legs 50 to secure the telescopic portions 62 is extended or retracted positions.

Front legs 48 are mounted in a similar manner to legs 50, with forked upper ends 82 hinged on bearing blocks 84 by pins 86. Each bearing block 84 has a pin 88 journalled in a mounting bracket 90 shaped to fit on the outwardly flared front wall 92 of seat 10, as in FIG. 5. Each mounting bracket 90 acts as a stop to limit forward inclination of the respective leg 48. The mounting brackets 90 are secured on the upper outer corner portions of front wall 92, so that front legs 48 are hinged higher inside the seat than legs 50. This allows the rear legs to fold over the front legs, as indicated in the broken line positions in FIG. 5. Front legs 48 have telescopic lower portions 94, which are secured by catches 80 and interconnected by a cross brace 96 similar in all respects to cross brace 64.

Figure 9:
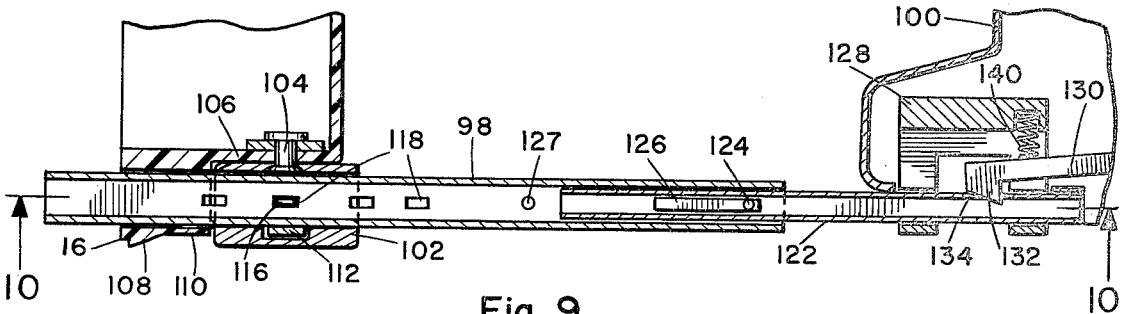
FIG. 9 is an enlarged sectional view taken on line 9—9 of FIG. 1.
Figure 10:
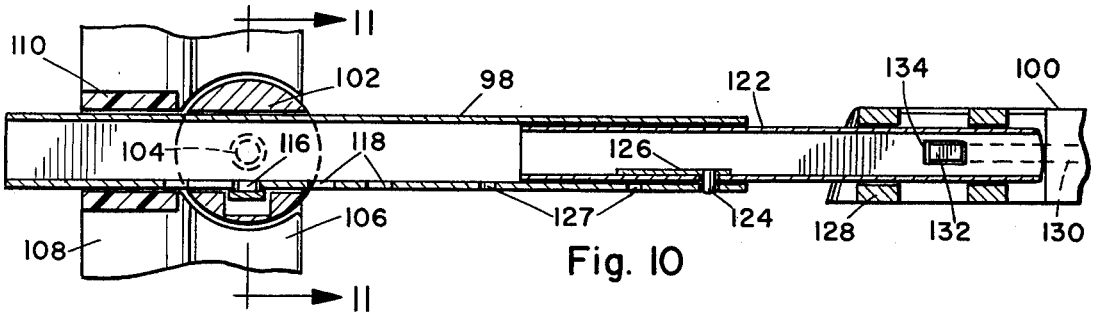
FIG. 10 is a sectional view taken on line 10—10 of FIG. 9.
Figure 11:
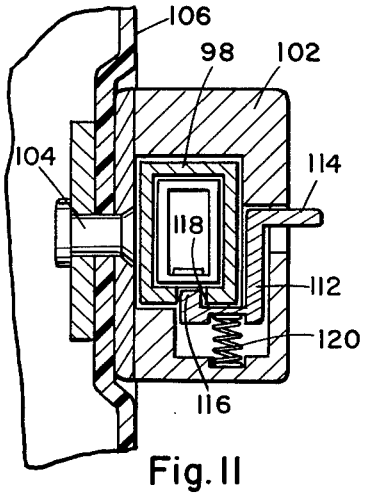
FIG. 11 is an enlarged sectional view taken on line 11—11 of FIG. 10.

On opposite sides of back 12 are arms 98 which extend forwardly and support a tray 100. Each arm 98 is slidably mounted in a cylindrical support block 102, which is rotatably attached to the back 12 by a pivot pin 104 through the side wall 106. The sides have outwardly flared portions 108 which increase the inner storage space and also leave the side walls 106 recessed. The side walls of seat 10 have corresponding flared portions 109 so that the edges 14 and 16 interfit around the periphery. In the stored position the coaxially pivoted support blocks 102 are rotated so that arms 98 are positioned vertically against the recessed side walls, with their lower ends seated in sockets 107, at the base of the side walls. In the erected position the arms are horizontal and are slid rearwardly through socket members 110 integral with the flared portions 108, which provides a firm support for the arms, as in FIGS. 9 and 10.

In each support block 102 is a latch 112 having an actuating tab 114 projecting from the outer face of the block. The inner end of the latch has a locking lug 116 which engages one of a plurality of holes 118 spaced along arm 98. A spring 120 biases latch 112 into engagement with the arm 98 to hold the arm at various positions of extension, the arm being adjusted by depressing tab 114 to release lug 116.

Each arm 98 has a telescopic front portion 122 which is held in place by a pin 124 on an internal spring catch 126, engaging one of a plurality of holes 127 in the arm. The catch is released by pressing pin 124 upwardly, the pin having a rounded end which will ride over the inside of arm 98, when the telescopic portion 122 is slidably adjusted. This type of catch is concealed from an infant seated in the chair and is not easily operable by an infant. The combination of the slidably adjustable arms 98 and telescopic portions 122 gives a wide range of adjustment for tray 100.

The forward ends of telescopic portions 122 plug into socket members 128 fixed in the outer rear corners of tray 100. The tray is secured at each socket member 128 by a latch arm 130 having a pawl 132 which seats in a hole 134 in the side of telescopic portion 122. The latch arm 130 is pivotally attached to the underside of tray 100 by a pivot pin 136 and has an actuating arm 138 which, when squeezed outwardly, releases the pawl 132 from hole 134. A spring 140 biases the latch arm 130 into the latched position. The latch mechanism is concealed under the tray and it is very unlikely that an infant could operate both latch arms simultaneously to remove the tray.

Figure 12:
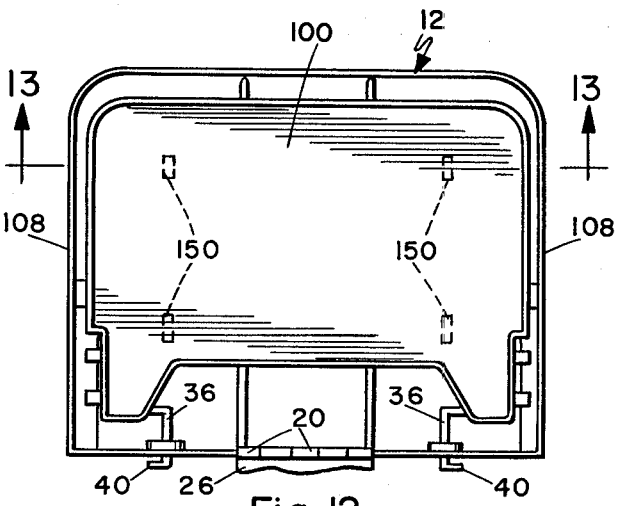
FIG. 12 is a rear elevation view of the back, showing the tray in stored position.
Figure 13:
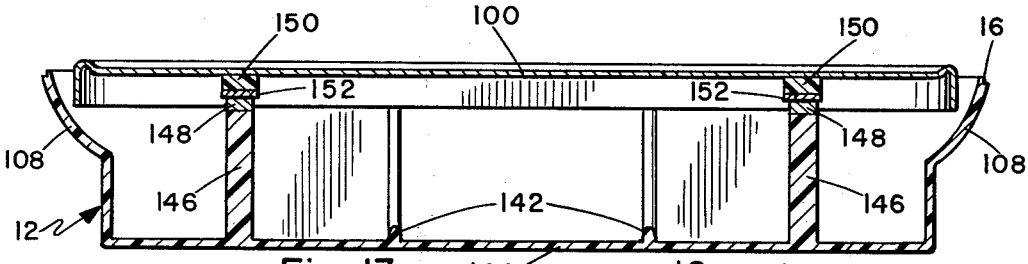
FIG. 13 is an enlarged sectional view taken on line 13—13 of FIG. 12.

Back 12 has reinforcing ribs 142 extending from hinge elements 20, across lower wall 32 and across front panel 144. On opposite sides of the ribs 142 are two pairs of posts 146 projecting rearwardly from front panel 144, and on the rear ends of the posts are secured magnets 148. On the underside of tray 100 are posts 150 spaced to correspond with posts 146, the posts 150 having metal caps 152 thereon to be gripped by magnets 148. The tray is thus held magnetically inside the back for storage, as in FIGS. 12 and 13. The flared side portions 108 provide clearance for the tray, the sides of which have cut outs 154 to clear the thickened portions formed by socket members 110.

Figure 15:
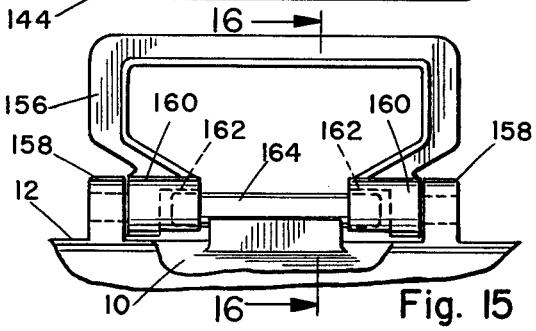
FIG. 15 is an enlarged side elevation view of the carrying handle.
Figure 14:
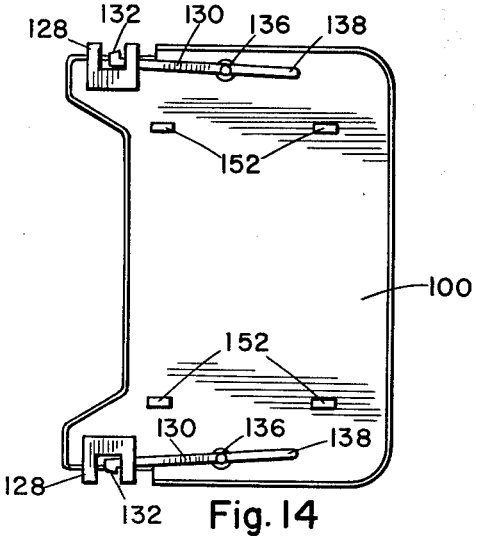
FIG. 14 is an underside view of the tray.
Figure 16:
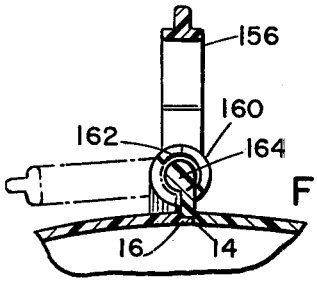
FIG. 16 is a sectional view taken on line 16—16 of FIG. 15.

A handle 156 is mounted on the upper rear edge of back 12 and is rotatable between brackets 158. The handle has spaced cylindrical hub portions 160 with opposed sockets 162, which have open sides for about 180 degrees of their circumference. Fixed on the lower front edge of seat 10 is a clamp bar 164, the ends of which fit into sockets 162 when the handle 156 is lowered. When the handle is lifted, as for carrying, the closed portions of the sockets 162 roll over the clamp bar 164 and lock the seat and back together, as in FIGS. 15 and 16.

Figure 2:
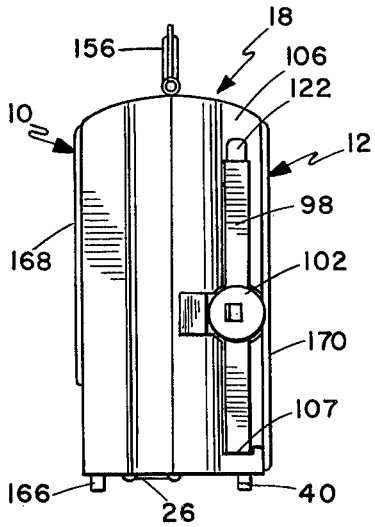
FIG. 2 is a side elevation view of the collapsed and closed chair.
Figure 3:
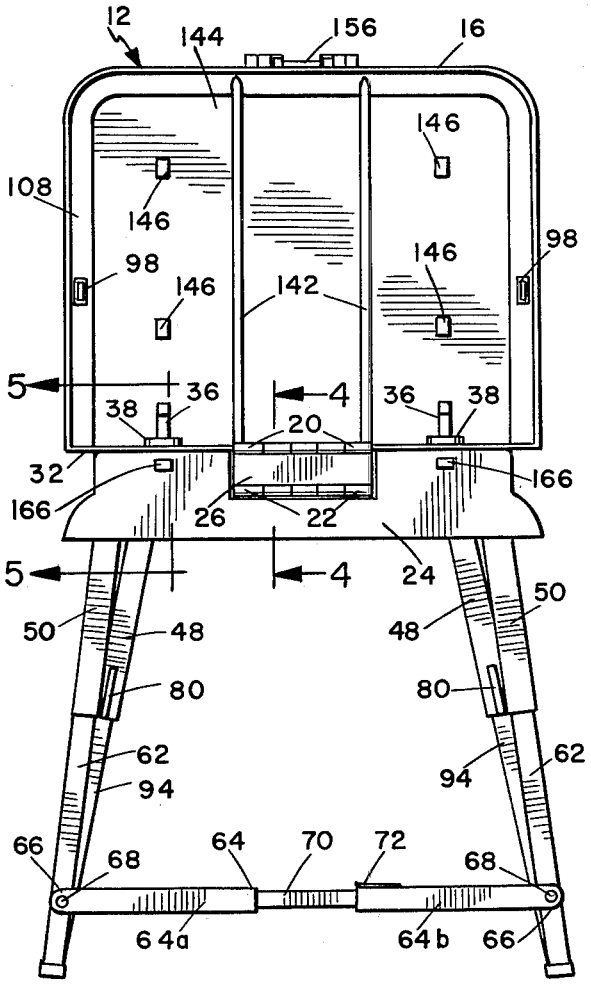
FIG. 3 is a rear elevation view of the erected chair.
Figure 4:
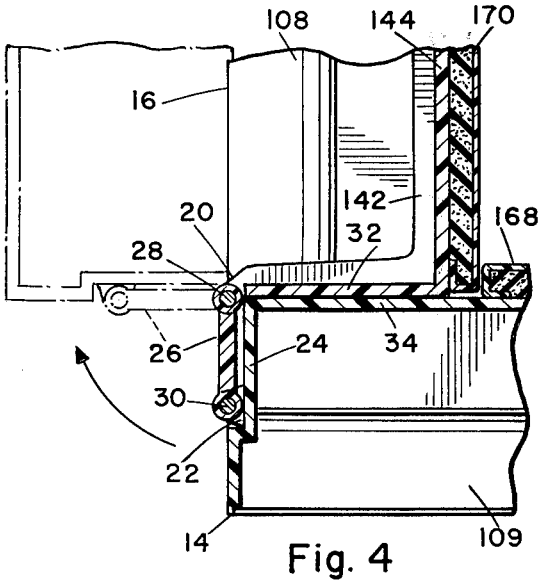
FIG. 4 is an enlarged sectional view taken on line 4—4 of FIG. 3.

In the closed position shown in FIG. 2, the hook portions 40 of clamps 36 project below the back and act as supporting feet. Other feet 166 are fixed on the rear panel 24 of seat 10 to provide level support for the closed case 18.

To collapse the chair the tray 100 is first removed by squeezing actuating arms 138 outwardly and sliding the tray forward off the arms. The tray is stored in back 12 by attachment to magnets 148. Telescopic portions 122 are then retracted into arms 98, which in turn are released and pulled forward clear of socket members 110. Support blocks 102 can then be rotated to move the arms to vertical positions and the arms are lowered to rest in sockets 107.

Cross braces 64 and 96 are collapsed to bring the legs inwardly and the telescopic portions 62 and 94 are retracted. Legs 48 and 50 can then be folded into the seat 10.

Latches 36 are unlocked and the seat and back are swung around to come together and form the closed case 18, which is locked shut by lifting handle 156.

The particular construction of the seat and back facilitates the use and storage of a large tray, while maintaining proper proportions of seat and back support. It is desirable to have proper back support when the infant's legs are hanging from the front of the seat, which sets limitations on the front to rear depth of the seat. Since the seat extends below the back in the erected position, the overall size of the seat element is considerably larger than the actual seating area, which increases internal storage space and provides a larger base for the legs. The spreading of the legs, made possible by the double axis hinges, provides a very stable support for the chair.

For comfort the seat 10 is provided with a suitable resilient pad 168, attached in any convenient manner to top panel 34. Back 12 has a similar pad 170 attached to front panel 144. The pads are on opposite sides of the closed case and can be made to add to the overall appearance of the unit.

It should be noted that in addition to the high chair configuration illustrated in FIG. 1, the chair can be set at a lower position by retracting the telescopic portions of the legs. Also, with the legs completely folded into the seat, the chair can be placed directly on any suitable supporting surface, such as a bench or a vehicle seat.

The chair is thus a versatile and safe structure, easy to operate and becomes an attractice luggage like unit when not in use.

Having described my invention, I claim:

1. A self-containing collapsible high chair, comprising:

a hollow seat having an open lower side;

a hollow back having an open rear side;

the lower portion of said seat and the rear portion of said back having corresponding interfitting peripheral edges;

hinge means connecting said back to said seat for movement between an erected position with the back substantially upright on the upper rear portion of the seat, and a closed position with the seat and back joined at said interfitting edges and forming a closed case;

a pair of front legs and a pair of rear legs having hinged connections to said seat to move between an extended position inclined outwardly from the seat and a retracted position within the hollow seat;

each of said hinged connections including a support member fixed to the seat and a bearing block pivotally mounted on the support member on an axis extending substantially from front to rear of the seat, each one of the legs being pivotally attached to one of the bearing blocks on an axis perpendicular to the pivotal axis of the bearing block;

each of said legs having a telescopic lower portion;

a cross brace secured between the telescopic portions of each pair of legs and being adjustable to hold the legs apart in the extended position and to hold the legs in substantially parallel position for retraction into the seat;

arms adjustably mounted on said back and extending forwardly therefrom above the seat; and a tray detachably secured to said arms.

2. A self containing collapsible high chair, comprising:

a hollow seat having an open lower side;

a hollow back having an open rear side;

the lower portion of said seat and the rear portion of said back having corresponding interfitting peripheral edges;

hinge means connecting said back to said seat for movement between an erected position with the back substantially upright on the upper rear portion of the seat, and a closed position with the seat and back joined at said interfitting edges and forming a closed case;

legs having hinged connections to said seat to move between an extended position inclined outwardly from the seat and a retracted position within the hollow seat;

each of said legs being hinged to the seat on two perpendicular axes, one axis extending substantially from front to rear of the seat;

arms adjustably mounted on said back and extending forwardly therefrom above the seat; and a tray detachably secured to said arms.

3. A collapsible high chair according to claim 2, wherein said legs include a pair of front legs and a pair of rear legs, each leg having a telescopic lower portion;

a cross brace secured between the telescopic portions of each pair of legs and being adjustable to hold the legs apart in the extended position and to hold the legs in substantially parallel relation for retraction into the seat.

4. A collapsible high chair according to claim 2, and including clamps mounted in said back and having locking portions for engagement with said seat to hold the back in the erected position on the seat.

5. A collapsible high chair according to claim 4, wherein said locking portions project from said back and comprise supporting feet for the closed case;

said seat having corresponding supporting feet thereon spaced from said locking portions.

6. A collapsible high chair according to claim 2, wherein said back has support means therein including posts projecting from the interior of the hollow back, with magnets on said posts, said tray having magnetically cooperative elements thereon for engagement with the magnets.

7. A collapsible high chair according to claim 6, wherein said back and said seat have outwardly flared side portions along the interfitting edges, said tray extending into the flared side portions when held on said support means.

8. A self containing collapsible high chair, comprising:

a hollow seat having an open lower side;

a hollow back having an open rear side;

the lower portion of said seat and the rear portion of said back having corresponding interfitting peripheral edges;

hinge means connecting said back to said seat for movement between an erected position with the back substantially upright on the upper rear portion of the seat, and a closed position with the seat and back joined at said interfitting edges and forming a closed case, legs having hinged connections to said seat to move between an extended position inclined outwardly from the seat and a retracted position within the hollow seat;

arms adjustably mounted on said back and extending forwardly therefrom above the seat;

said back having a pair of support blocks coaxially pivotally mounted on opposite sides thereof, said arms being slidably mounted in said support blocks;

retaining means for receiving and holding said arms in the forwardly extending position; and a tray detachably secured to said arms.

9. A collapsible high chair according to claim 8, wherein said retaining means comprises a socket member in said back immediately rearwardly of each support block.

10. A collapsible high chair according to claim 9, and including a releasable catch in each of said support blocks for holding the respective arm in selected positions therein.

11. A collapsible high chair according to claim 10, wherein said back has recessed side portions to receive said arms in a retracted position with said support blocks rotated from the extended position of the arms.

12. A collapsible high chair according to claim 11, wherein said arms have telescopically adjustable extension portions to which said tray is attached.

13. A collapsible high chair according to claim 12, wherein said tray has socket members for receiving said extension portions, and latches mounted on said tray for engagement with the extension portions to secure the tray thereon.

* * * * *